US011774879B2

(12) United States Patent
Inada et al.

(10) Patent No.: US 11,774,879 B2
(45) Date of Patent: Oct. 3, 2023

(54) TONER CONVEYING APPARATUS HAVING A LIGHT TRANSMISSION PORTION

(71) Applicant: CANON KABUSHIKI KAISHA, Tokyo (JP)

(72) Inventors: Seiji Inada, Shizuoka (JP); Tsukasa Abe, Kanagawa (JP); Takashi Kuwata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/547,913

(22) Filed: Dec. 10, 2021

(65) Prior Publication Data

US 2022/0197183 A1 Jun. 23, 2022

(30) Foreign Application Priority Data

Dec. 23, 2020 (JP) ..... 2020-213834

(51) Int. Cl.
*G03G 15/08* (2006.01)

(52) U.S. Cl.
CPC ..... *G03G 15/0862* (2013.01); *G03G 15/0891* (2013.01); *G03G 15/0894* (2013.01); *G03G 2215/0827* (2013.01); *G03G 2215/0894* (2013.01); *G03G 2215/0897* (2013.01)

(58) Field of Classification Search
CPC ..... G03G 15/0862; G03G 15/0891; G03G 15/0894; G03G 2215/0827; G03G 2215/0891; G03G 2215/0894; G03G 2215/0897; G03G 15/0855
See application file for complete search history.

(56) References Cited

U.S. PATENT DOCUMENTS 4,135,642 A * 1/1979 Forward ..... G03G 15/0872 222/23
2007/0071502 A1* 3/2007 Shimizu ..... G03G 15/0879 399/258

(Continued)

FOREIGN PATENT DOCUMENTS

JP 2016099475 A 5/2016
JP 2017191259 A 10/2017
JP 2019159055 A 9/2019

*Primary Examiner* — Arlene Heredia
*Assistant Examiner* — Laura Roth
(74) *Attorney, Agent, or Firm* — Canon U.S.A., Inc. I.P. Division

(57) ABSTRACT

A toner conveying apparatus includes a frame body, a conveyance member, a light transmission portion, a light emission portion, a light reception portion, and a rubbing member. The frame body forms a conveyance passage surrounded by a wall portion and is provided with a reception inlet for receiving toner from outside. The conveyance member is provided in the conveyance passage and rotates around a first rotation axis to convey the toner. The light transmission portion that is provided in the wall portion and has translucency. The light emission portion emits light toward an inside of the conveyance passage through the light transmission portion. The light reception portion receives the light emitted from the light emission portion through the light transmission portion. The rubbing member rubs on the light transmission portion by being rotated around a second rotation axis extending in a direction crossing the first rotation axis.

23 Claims, 9 Drawing Sheets

(56) References Cited

U.S. PATENT DOCUMENTS

| | | | | |
|---|---|---|---|---|
| 2007/0242993 | A1* | 10/2007 | Tanaka | G03G 15/0855 399/358 |
| 2011/0222871 | A1* | 9/2011 | Suzuki | G03G 15/0889 399/27 |
| 2012/0020683 | A1* | 1/2012 | Miura | G03G 15/0862 399/27 |
| 2012/0224889 | A1* | 9/2012 | Tajiri | G03G 15/0862 399/261 |
| 2016/0154341 | A1* | 6/2016 | Hamada | G03G 15/0891 399/358 |

* cited by examiner

TONER CONVEYING APPARATUS HAVING A LIGHT TRANSMISSION PORTION

BACKGROUND

Field

The present disclosure relates to a toner conveying apparatus used in an image formation apparatus using an electrophotographic system, such as a printer, a copying machine, and a facsimile machine.

Description of the Related Art

Some image formation apparatuses using an electrophotographic system include a toner conveying apparatus that receives toner from the outside and conveys the toner to an image formation portion. In addition, some toner conveying apparatus include a remaining amount detection unit that detects an amount of remaining toner.

There is known a configuration of the remaining amount detection unit in which the amount of remaining toner is detected using a light transmission portion provided in a frame body and a light detection sensor. In this configuration, the light transmission portion needs to be in a state letting light pass. Japanese Patent Application Laid-Open No. 2017-191259 discusses that a cleaning member is provided to remove adhering toner from the light transmission portion.

SUMMARY

According to an aspect of the present disclosure, a toner conveying apparatus includes a frame body configured to form a conveyance passage surrounded by a wall portion and is provided with a reception inlet for receiving toner from outside, a conveyance member that is provided in the conveyance passage and configured to rotate around a first rotation axis to convey the toner, a light transmission portion that is provided in the wall portion and has translucency, a light emission portion configured to emit light toward an inside of the conveyance passage through the light transmission portion, a light reception portion configured to receive the light emitted from the light emission portion through the light transmission portion, and a rubbing member configured to rub on the light transmission portion by being rotated around a second rotation axis extending in a direction crossing the first rotation axis.

Further features of the present disclosure will become apparent from the following description of exemplary embodiments with reference to the attached drawings.

DESCRIPTION OF THE EMBODIMENTS

<Image Formation Apparatus>

Figure 1:
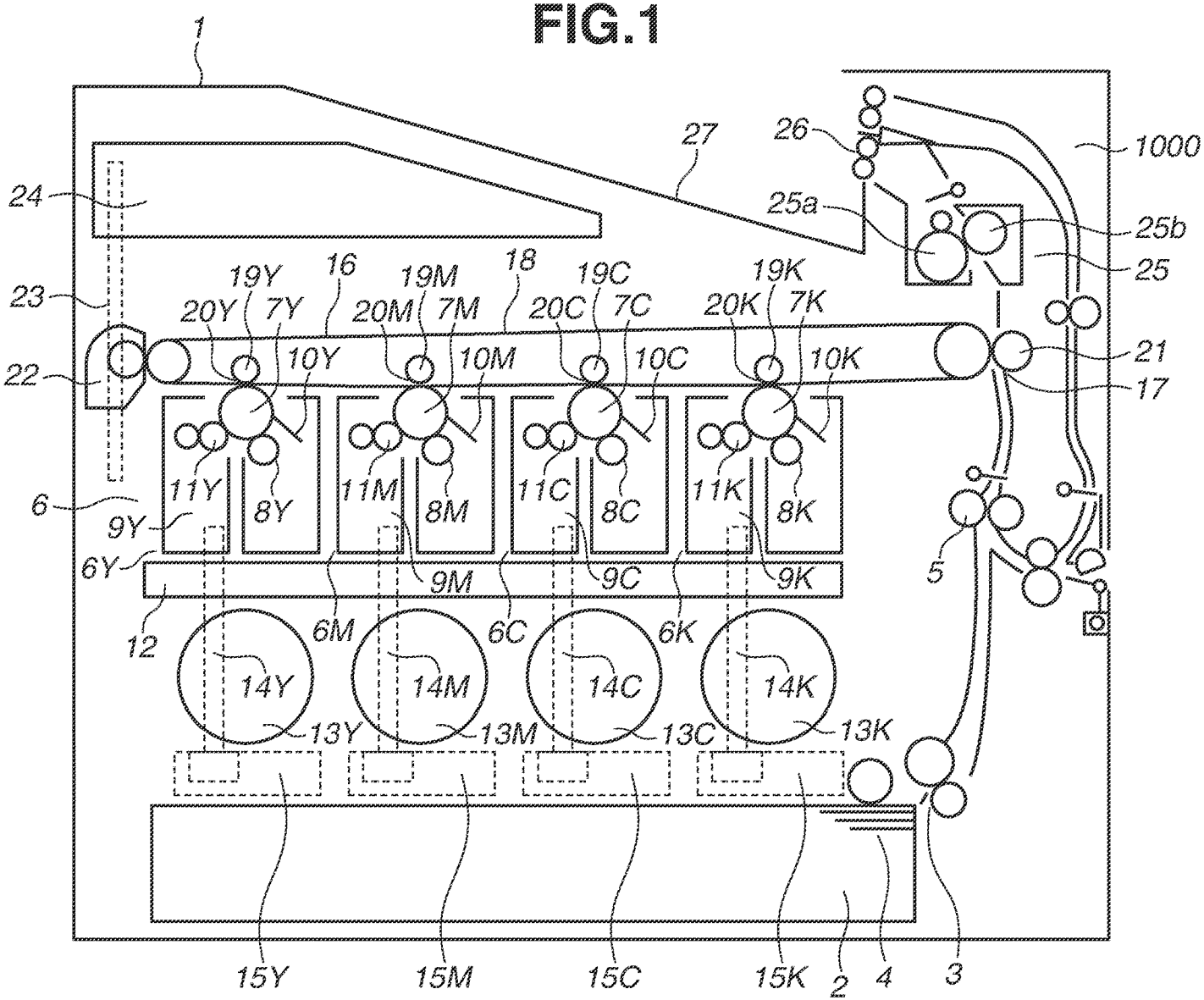
FIG. 1 is a schematic cross-sectional view of an image formation apparatus according to a first exemplary embodiment.

An image formation apparatus 1 according to a first exemplary embodiment will be described. FIG. 1 is a schematic cross-sectional view of the image formation apparatus 1 according to the present exemplary embodiment.

The image formation apparatus 1 includes process cartridges 6Y, 6M, 6C, and 6K (hereinafter, process cartridges 6) detachably attached to an apparatus main body 1000. The process cartridges 6 each include a photoconductive drum 7, a cleaning blade 10, a charging device 8, and a development device 9. The development device 9 includes a development roller 11 for supplying toner to the photoconductive drum 7.

The image formation apparatus 1 irradiates the photoconductive drums 7 with laser light from a laser scanner unit 12 based on image information acquired by a control unit (not illustrated). Accordingly, latent images formed on the photoconductive drums 7 are developed as toner images with the toner supplied from the development rollers 11.

The developed toner images are transferred by primary transfer units 20 onto an intermediate transfer belt 18. Continuously transferring the toner image in each color forms a toner image in four colors on a surface of the intermediate transfer belt 18. The toner image is conveyed to a secondary transfer portion 17.

Toner containers 13 (13Y, 13M, 13C, and 13K) are provided under the process cartridges 6.

The image formation apparatus 1 includes toner conveying apparatuses 14 that supply toner from the toner containers 13 to the process cartridges 6. The toner conveying apparatuses 14 are driven by corresponding toner conveyance drive devices 15 arranged at the lower portions of the toner conveying apparatuses 14.

A recording material 4 is stored in a cassette 2 in the lower portion of the image formation apparatus 1. When a pickup roller 3 rotates, sheets of the recording material 4 are separated and fed one by one. After that, the recording material 4 is conveyed downward by a registration roller 5.

An intermediate transfer unit 16 is provided above the process cartridges 6. The intermediate transfer unit 16 is arranged almost horizontally with each side of the primary transfer units 20 downward. The intermediate transfer belt 18 facing the photoconductive drums 7 is a rotatable endless belt and is extended by a plurality of extension rollers. Inside the intermediate transfer belt 18, primary transfer rollers 19 as primary transfer members are arranged at positions where the primary transfer rollers 19 and the photoconductive drum 7 form the primary transfer units 20 with the intermediate transfer belt 18 in between. At each of the primary transfer units 20, a toner image is transferred from the photoconductive drum 7 onto the intermediate transfer belt 18 by the primary transfer roller 19, to which voltage is applied. In the present exemplary embodiment, a unit including the intermediate transfer belt 18, the plurality of extension rollers by which the intermediate transfer belt 18 is extended, and the primary transfer rollers 19 is detachably attached, as the intermediate transfer unit 16, to the apparatus main body.

A secondary transfer roller 21 as a secondary transfer member is in contact with the intermediate transfer belt 18 and forms a secondary transfer portion 17 together with an opposing roller with the intermediate transfer belt 18 in between. At the secondary transfer portion 17, the toner image transferred onto the intermediate transfer belt 18 is secondarily transferred onto the recording material 4. The toner left on the intermediate transfer belt 18 without being secondarily transferred onto the recording material 4 is removed by a cleaning unit 22. The toner removed by the cleaning unit 22 is conveyed to and accumulated in a toner collection container 24 through a collected toner conveyance portion 23.

The recording material 4 with the unfixed toner image is further conveyed downward, and pressurized and heated by a heating unit 25*a* and a pressure roller 25*b* of a fixing device 25. When the toner is melted, the toner image is fixed to the recording material 4. After that, the recording material 4 is conveyed to an ejection roller pair 26 and ejected to an ejection tray 27. By a series of operations described above, image formation is performed on a surface of the recording material 4.

<Toner Conveying Apparatus>

Figure 2:
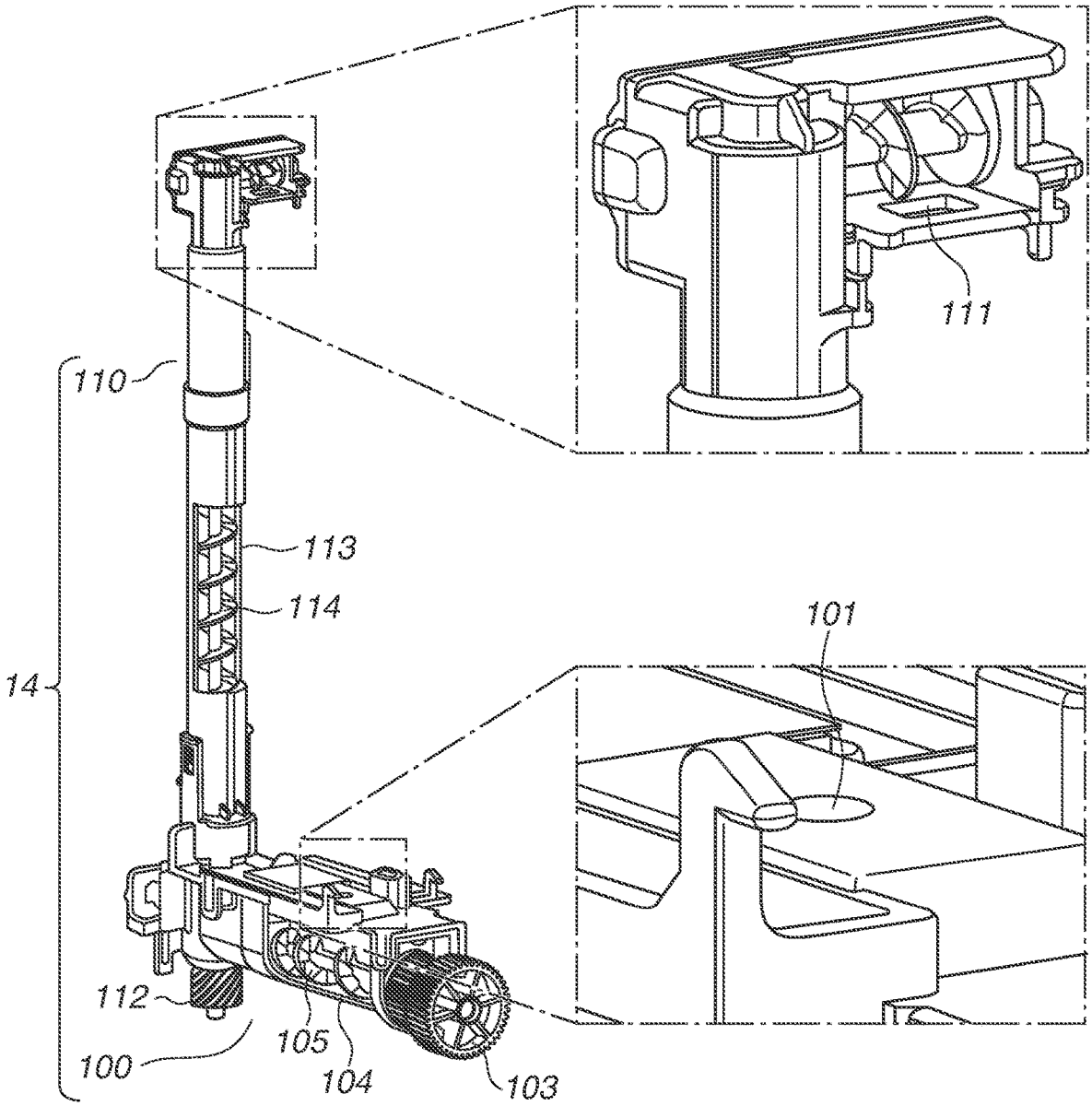
FIG. 2 is an overall perspective view of a toner conveying apparatus according to the first exemplary embodiment.

FIG. 2 is an overall perspective view of one toner conveying apparatus 14 mounted in the image formation apparatus. In the illustration of FIG. 2, the frame body is partially cut out so that the inside of the toner conveying apparatuses 14 can be seen through.

As illustrated in FIG. 2, each toner conveying apparatus 14 includes an upstream conveyance portion 100 and a downstream conveyance portion 110 that conveys toner having been conveyed by the upstream conveyance portion 100.

The upstream conveyance portion 100 includes a first frame body 104 that forms a conveyance passage (a first conveyance passage or a first toner storage portion) covered with a wall surface (a wall portion) and an upstream screw 105 (a first conveyance member). At an upstream end of the upstream conveyance portion 100 as seen in a toner conveyance direction of the upstream screw 105, a drive gear 103 (a first drive force reception portion) is provided to receive a drive force for rotating the upstream screw 105 from the toner conveyance drive device 15 illustrated in FIG. 1. The first frame body 104 of the upstream conveyance portion 100 is provided with a supply port 101 (a reception inlet) for receiving a supply of toner from the toner container 13. The toner supplied from the supply port 101 is horizontally conveyed in the first frame body 104 by the upstream screw 105 and reaches the downstream conveyance portion 110.

The downstream conveyance portion 110 includes a second frame body 113 that forms a conveyance passage (a second conveyance passage or a second toner storage portion) covered with a wall surface (a wall portion) and a downstream screw 114 (a second conveyance member). At a lower end of the downstream conveyance portion 110 below the downstream screw 114, a downstream drive gear 112 (a second drive force reception portion) is provided to receive a drive force for rotating the downstream screw 114. The downstream screw 114 conveys toner in a vertically upward direction. The toner conveyed by the downstream screw 114 is supplied to the development device 9 in the process cartridge 6 through a discharge port 111. The direction in which the toner is conveyed by the upstream conveyance portion 100 is not necessarily a horizontal direction but can be inclined with respect to the horizontal direction. The direction in which the toner is conveyed by the upstream conveyance portion 100 is not necessarily a vertical direction but can be inclined with respect to the vertical direction. The toner conveyance direction of the upstream conveyance portion 100 is closer to the horizontal direction than the toner conveyance direction of the downstream conveyance portion 110.

<Upstream Conveyance Portion>

Figure 3A:
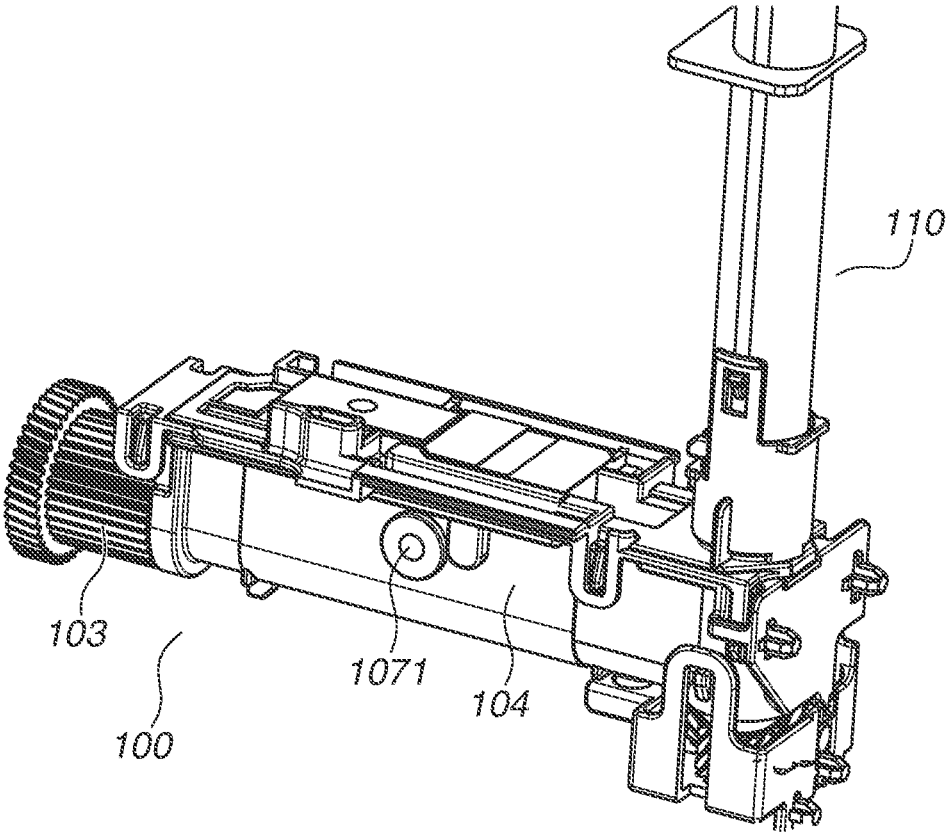
FIGS. 3A and 3B are enlarged perspective views of an upstream conveyance portion according to the first exemplary embodiment.
Figure 3B:
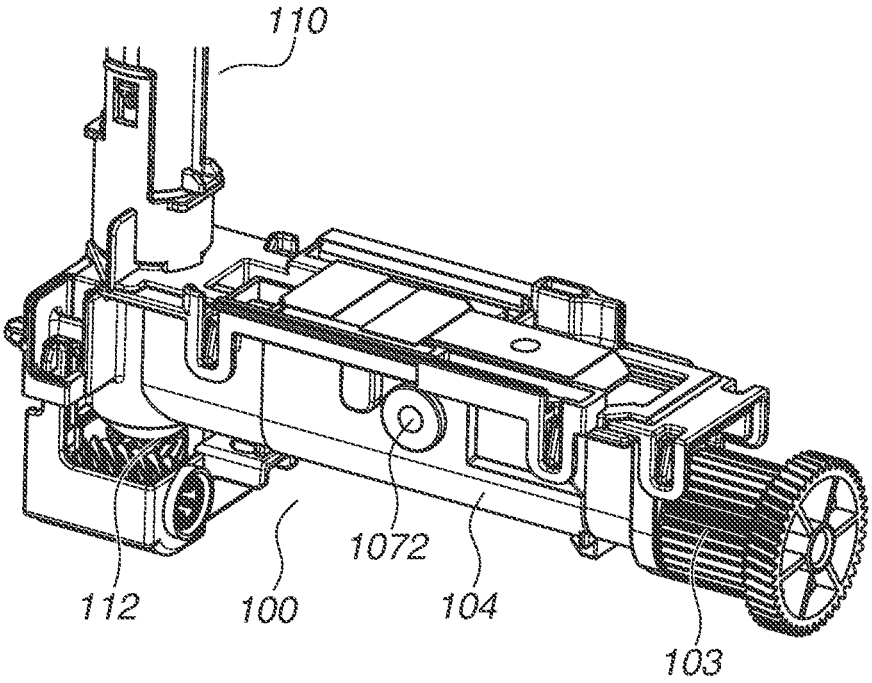
Figure 4A:
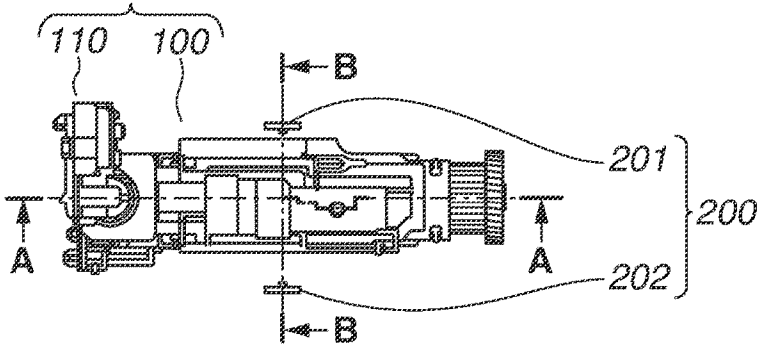
FIG. 4A is an upper view of the upstream conveyance portion.
Figure 4B:
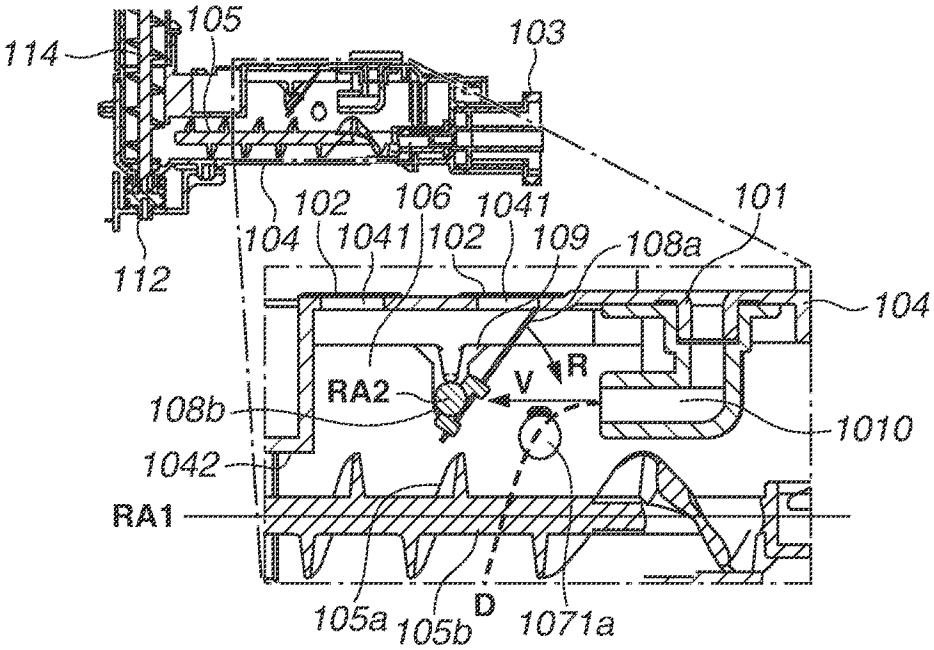
FIGS. 4B and 4C are cross-sectional views of the same, according to the first exemplary embodiment.
Figure 4C:
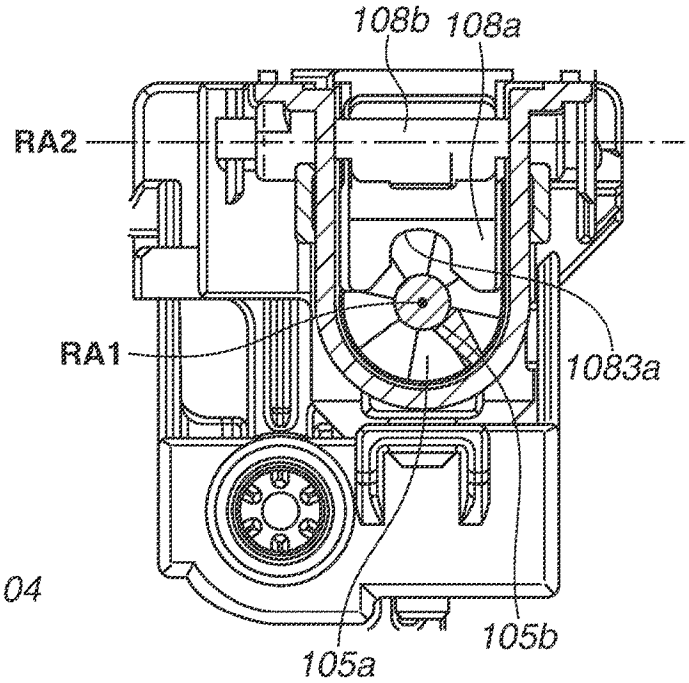
Figure 5:
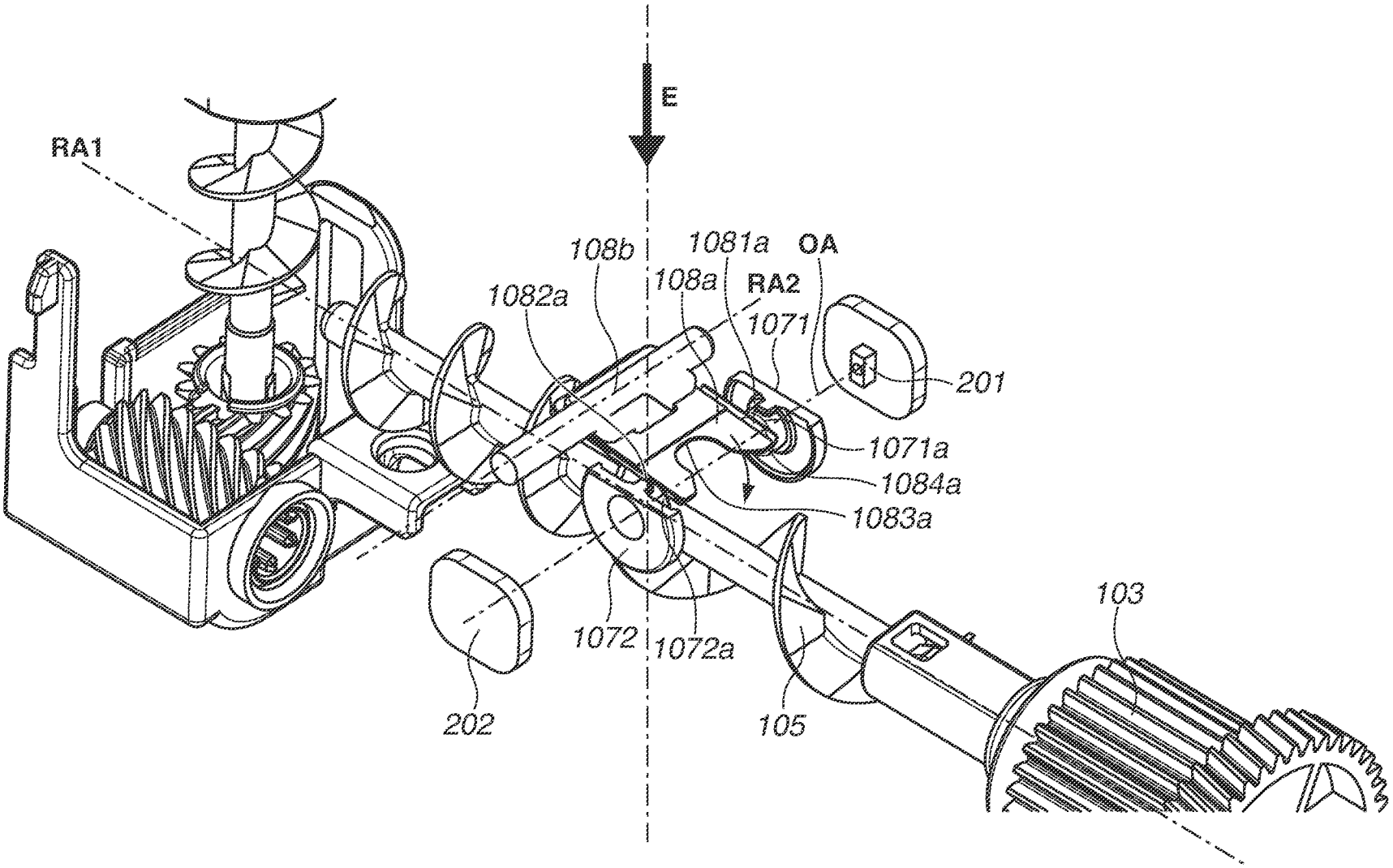
FIG. 5 is a perspective view of the upstream conveyance portion without a first frame body according to the first exemplary embodiment.
Figure 6:
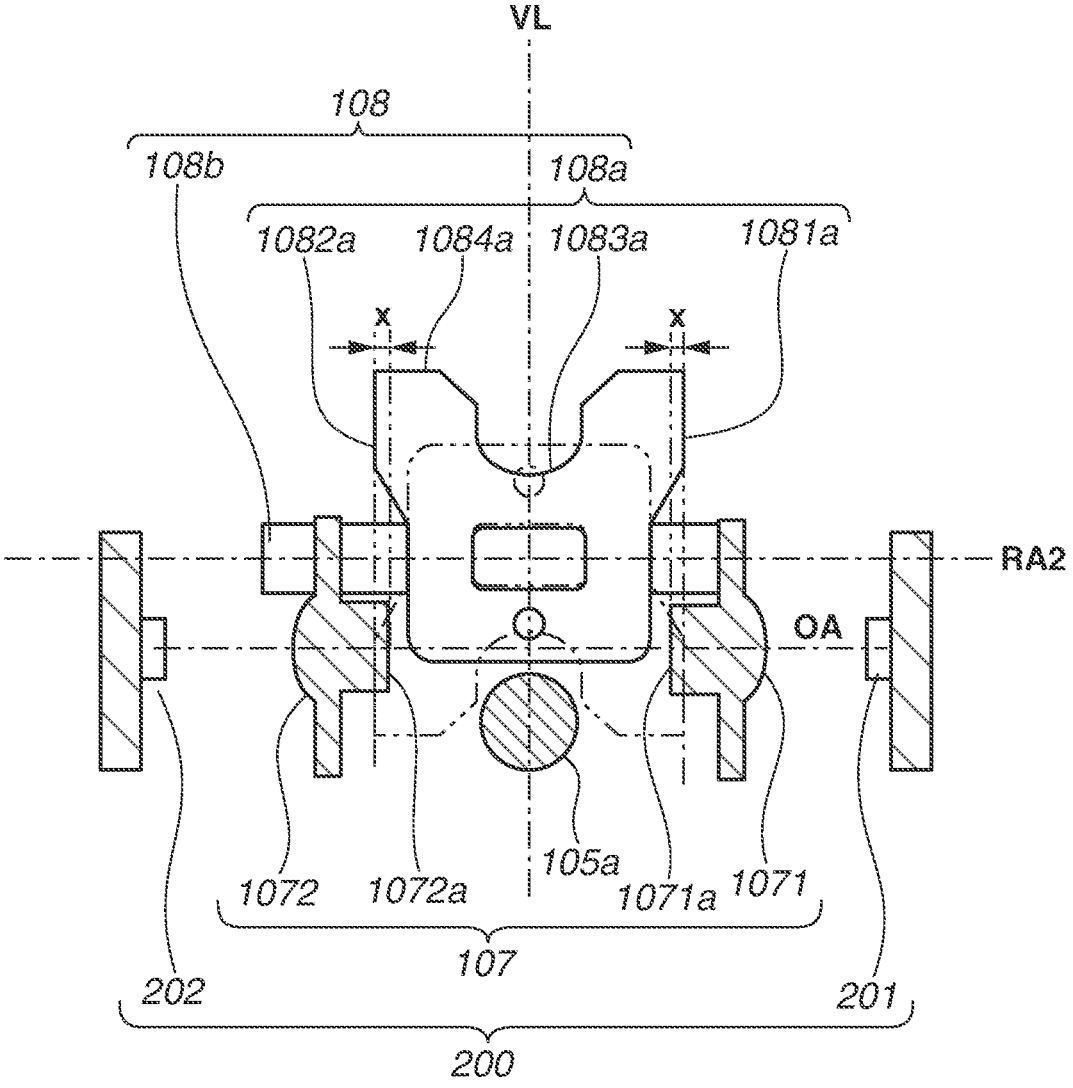
FIG. 6 is a diagram of a cleaning member, a light transmission portion, and an optical sensor as seen in a direction of a first rotation axis according to the first exemplary embodiment.

The upstream conveyance portion 100 will be described in detail with reference to FIGS. 3A to 6. FIG. 3A is an enlarged perspective view of the upstream conveyance portion 100. FIG. 3B is a perspective view of the upstream conveyance portion 100 as seen from the side opposite to FIG. 3A. FIG. 4A is a top view of the upstream conveyance portion 100. FIG. 4B is a cross-sectional view of FIG. 4A taken along A-A and its enlarged proportional cross-sectional view thereof. FIG. 4C is a cross-sectional view of FIG. 4A taken along B-B. FIG. 5 is an exploded perspective view of the upstream conveyance portion 100 (the first frame body 104 is not illustrated). FIG. 6 is a diagram illustrating a layout of an optical sensor 200, a light transmission portion 107, and a cleaning member 108 in the B-B cross section of FIG. 4A.

The upstream conveyance portion 100 includes the upstream screw 105, the first frame body 104, a supply tube 1010, the optical sensor 200, and the light transmission portion 107.

As illustrated in FIGS. 4B and 5, the upstream screw 105 includes a rotation shaft 105*b* (a first shaft portion) that rotates around a first rotation axis RA1 and a blade portion 105*a* provided outside the rotation shaft 105*b*. In the present exemplary embodiment, the blade portion 105*a* is a spiral portion with the first rotation axis RA1 as a spiral axis and rotates together with the rotation shaft 105*b*. The upstream screw 105 can convey the toner by the rotation of the blade portion 105*a* in a direction of the first rotation axis RA1. Hereinafter, a direction in which the toner is conveyed by the upstream screw 105 will be referred to a toner conveyance direction.

The first frame body 104 is a cylindrical member to cover the periphery of the upstream screw 105 with the wall surface (the wall portion) and includes the supply port 101 on the top surface. The first frame body 104 has a shape elongated in the direction of the first rotation axis RA1.

As illustrated in FIG. 4B, the supply tube 1010 is a tube for discharging the toner having been supplied from the supply port 101 into the first frame body 104. The supply tube 1010 extends in the direction of the first rotation axis RA1 within the first frame body 104.

In the present exemplary embodiment, toner is supplied from the toner container 13 together with the air through the supply port 101. The toner passes through the supply tube 1010 and is discharged into the first frame body 104. As illustrated in FIG. 4B, the toner having been discharged from the supply tube 1010 is discharged in a direction of an arrow V, which is the direction of the first rotation axis RA1, and drops under its own weight into a lower portion of the first frame body 104 provided with the upstream screw 105. A dashed line D illustrated in FIG. 4B indicates a passage area (trajectory) through which the toner passes from an exit of the supply tube 1010 to the lower portion of the first frame body 104 provided with the upstream screw 105. The first frame body 104 contains a space 106 above the upstream screw 105 so that, even if the toner is excessively supplied from the toner container 13 via the supply tube 1010, the toner will not flow out of the first frame body 104. The space 106 is a space above an upper surface (a top surface) 1042 of the first frame body 104 on the downstream side as seen in the toner conveyance direction. The downstream side of the first frame body 104 with the upper surface 1042 as seen in the toner conveyance direction is smaller in cross-section area than the upstream side provided with the space 106 for compressing the toner. This is because compressing the toner toward the downstream conveyance portion 110 allows the toner to be easily conveyed by the downstream screw 114 in the vertically upward direction.

The first frame body 104 includes a through-hole 1041 formed on the upper surface and a filter 102 provided on the through-hole 1041 to suppress the toner from being discharged from the through-hole 1041 to the outside of the first frame body 104. The through-hole 1041 is provided more downward than the supply tube 1010 as seen in the toner conveyance direction. Allowing the air having flown in the first frame body 104 to be discharged from the supply tube 1010 via the filter 102 to the outside of the first frame body 104 prevents an excessive increase in an internal pressure of the first frame body 104.

<Optical Sensor>

The optical sensor 200 is a detection unit that detects whether toner is normally supplied from the toner container 13 to the toner conveying apparatus 14. In other words, the optical sensor 200 is a detection unit that detects an amount of remaining toner (the presence or absence of toner) in the toner container 13.

As illustrated in FIG. 4A, the optical sensor 200 is arranged outside the first frame body 104. As illustrated in FIG. 5, the optical sensor 200 includes a light emission element 201 (a light emission portion) and a light reception element 202 (a light reception portion). The light emission element 201 (the light emission portion) and the light reception element 202 (the light reception portion) are aligned in a direction orthogonal to the direction of the arrow V (see FIG. 4B) in which the toner is discharged from the supply tube 1010.

A direction of an optical axis OA of the light emission element 201 is a direction orthogonal to (crossing) the first rotation axis RA1 of the upstream screw 105 as illustrated in FIG. 5. The light emission element 201 and the light reception element 202 are aligned with the first rotation axis RA1 of the upstream screw 105 in between in the direction orthogonal to (crossing) the first rotation axis RA1.

The light emission element 201 is arranged at a position where an emitted light (the optical axis OA) passes through the toner passage area D illustrated in FIG. 4B. The toner passage area D is an area vertically below the supply tube 1010 and on the downstream side as seen in the toner conveyance direction. The light reception element 202 is arranged at a position where the light having passed through the toner passage area D can be received.

Light from the light emission element 201 passes through the toner passage area D in the first frame body 104 and is received to be converted into an electrical signal by the light reception element 202. The light having passed through the toner passage area D changes in intensity depending on the amount of toner discharged from the supply tube 1010, and its intensity is converted into the intensity of the electrical signal. The electrical signal is compared to a preset threshold to detect the amount of remaining toner (the presence or absence of toner) in the toner container 13.

<Light Transmission Portion>

The first frame body 104 in the present exemplary embodiment is formed of polycarbonate (PC)/acrylonitrile butadiene styrene (ABS), and thus has no light transmission characteristics. Accordingly, the first frame body 104 includes a light transmission portion 107 (a light permeable unit) so that the light from the light emission element 201 outside the first frame body 104 can pass through the first frame body 104. The light transmission portion 107 in the present exemplary embodiment is formed of an acrylic resin (polymethyl methacrylate resin). However, the light transmission portion 107 is not limited to an acrylic resin but can be a transparent or translucent member formed of polycarbonate or polypropylene.

As illustrated in FIGS. 5 and 6, the light transmission portion 107 includes a first light transmission window 1071 (a first light permeable window) and a second light transmission window 1072 (a second light permeable window). The first light transmission window 1071 and the second light transmission window 1072 are provided between the light emission element 201 and the light reception element 202 as seen in the direction of the optical axis OA.

The first light transmission window 1071 and the second light transmission window 1072 are attached to walls extending in the direction of the first rotation axis RA1 of the first frame body 104 to face each other as illustrated in FIGS. 3A and 3B, respectively. In the first frame body 104 elongated in the direction of the first rotation axis RA1, the optical axis OA is extended in the direction orthogonal to the first rotation axis RA1 so that the first light transmission window 1071 and the second light transmission window 1072 can be easily arranged.

The light emission element 201 is configured to emit light toward the toner passage area D of the first frame body 104 (see FIG. 4B) via the first light transmission window 1071. The light reception element 202 is configured to receive the light emitted from the light emission element 201 via the second light transmission window 1072.

<Cleaning Member>

A first detection surface 1071*a* and a second detection surface 1072*a* are exposed surfaces of the first light transmission window 1071 and the second light transmission window 1072, respectively, in the first frame body 104. When being discharged from the supply tube 1010 or conveyed by the upstream screw 105, toner may float in the air and adhere to the first detection surface 1071*a* and the second detection surface 1072*a*. If the toner adheres to these surfaces, the optical sensor 200 becomes always light-shielded, which makes it impossible to detect a supply state of the toner from the toner container 13 to the toner conveying apparatus 14.

Thus, the cleaning member 108 (a rubbing member) is provided at the upstream conveyance portion 100 to remove the adhering toner from the first detection surface 1071*a* and the second detection surface 1072*a*.

As illustrated in FIGS. 4B and 5, the cleaning member 108 is arranged in the first frame body 104 and includes a rotation shaft 108*b* (a second shaft portion) that rotates around a second rotation axis RA2 and a sheet 108*a* that rotates together with the rotation shaft 108*b*. The sheet 108*a* is a flexible member that is formed of a urethane rubber sheet or a polyethylene terephthalate (PET) film.

In the toner conveyance direction, the supply tube 1010 (the supply port 101), the light transmission portion 107 (the first light transmission window 1071 and the second light transmission window 1072), and the cleaning member 108 are aligned in this order.

As illustrated in FIG. 5, the second rotation axis RA2 extends in a direction orthogonal to (crossing) the first rotation axis RA1. The second rotation axis RA2 extends in the direction of the optical axis OA and resides at a position different from the optical axis OA as seen in the direction orthogonal to the first rotation axis RA1. In the present exemplary embodiment, the second rotation axis RA2 is located above and downstream of the optical axis OA as seen in the toner conveyance direction. This configuration can implement a cleaning mechanism in a smaller space than in a configuration where the rotation axis of the conveyance screw and the rotation axis of the cleaning member are in the same direction, that is, a configuration where the cleaning member is rotated around the rotation axis of the conveyance screw.

As illustrated in FIG. 5, when is seen in an E direction (a first direction) vertical to both the first rotation axis RA1 and the second rotation axis RA2, the rotation shaft 108*b* of the cleaning member 108 overlaps the rotation shaft 105*b* of the upstream screw 105. In addition, as illustrated in FIG. 4B, the rotation shaft 108*b* is rotatably supported by a support portion 109 provided at the first frame body 104.

In the present exemplary embodiment, the cleaning member 108 rotates in an R direction illustrated in FIG. 4B when the rotation shaft 108*b* receives a drive force from the toner conveyance drive device 15 (see FIG. 1).

A method for cleaning the first detection surface 1071*a* and the second detection surface 1072*a* by the cleaning member 108 will be described. In FIG. 6, the sheet 108*a* with a leading end 1084*a* facing up is illustrated by a solid line, and the sheet 108*a* with the leading end 1084*a* facing down is illustrated by a dashed line. The leading end 1084*a* of the sheet 108*a* is an end as seen in a direction orthogonal to the direction of the second rotation axis RA2, and is a free end of the sheet 108*a*. The sheet 108*a* has a symmetrical shape with respect to a virtual line VL passing through a midpoint between the first detection surface 1071*a* and the second detection surface 1072*a*, and extending in the direction orthogonal to the second rotation axis RA2.

The sheet 108*a* includes a first end portion 1081*a* and a second end portion 1082*a* opposite to the first end portion 1081*a* as seen in the direction of the second rotation axis RA2. When the rotation shaft 108*b* is rotated in the R direction of FIG. 4B, the first end portion 1081*a* and the second end portion 1082*a* rub on the first detection surface 1071*a* and the second detection surface 1072*a*, respectively. Accordingly, the adhering toner is removed from the first detection surface 1071*a* and the second detection surface 1072*a*.

The first end portion 1081*a* and the second end portion 1082*a* of the sheet 108*a* are configured to advance by a distance X into the first detection surface 1071*a* and the second detection surface 1072*a*, respectively.

In other words, the first end portion 1081*a* and the second end portion 1082*a* of the sheet 108*a* overlap by the distance X the first detection surface 1071*a* and the second detection surface 1072*a*, respectively, in the direction of the second rotation axis RA2. Accordingly, each time the rotation shaft 108*b* is rotated, the cleaning member 108 can stably clean the first detection surface 1071*a* and the second detection surface 1072*a*.

Further, the sheet 108*a* includes a recessed portion 1083*a* that is recessed in a direction from the leading end 1084*a* toward the second rotation axis RA2. The recessed portion 1083*a* is provided between the first end portion 1081*a* and the second end portion 1082*a* as seen in the direction of the second rotation axis RA2. As illustrated in FIGS. 6 and 4C, when the leading end 1084*a* of the sheet 108*a* is in a rotation phase facing the rotation shaft 105*b* of the upstream screw 105, at least a portion of the rotation shaft 105*b* enters the recessed portion 1083*a*. This brings the rotation shaft 108*b* of the cleaning member 108 closer to the rotation shaft 105*b* of the upstream screw 105 without interference between the sheet 108*a* and the rotation shaft 105*b*. This configuration realizes further space-saving of the first frame body 104.

As described above, in the present exemplary embodiment, the second rotation axis RA2 of the rotation shaft 108*b* of the cleaning member 108 crosses the first rotation axis RA1 of the upstream screw 105, and the sheet 108*a* rubs on the light transmission portion 107 at the time of rotation of the rotation shaft 108*b*. This allows the toner conveying apparatus 14 to be configured in a space-saving manner.

The first frame body 104 in the present exemplary embodiment has a cylindrical shape elongated in the direction of the first rotation axis RA1. However, the first frame body 104 is not limited to this shape.

In the present exemplary embodiment, the second rotation axis RA2 of the rotation shaft 108*b* of the cleaning member 108 extends in the direction orthogonal to the first rotation axis RA1. However, the second rotation axis RA2 is merely required to extend in a direction crossing the first rotation axis RA1.

In the present exemplary embodiment, the sheet 108*a* of the cleaning member 108 is configured to, when the rotation shaft 108*b* is rotated, clean the first light transmission window 1071 and the second light transmission window 1072 at the same time. However, the sheet 108*a* of the cleaning member 108 is not limited to this configuration. The sheet 108*a* of the cleaning member 108 can be configured to, when the rotation shaft 108*b* is rotated, clean alternately the first light transmission window 1071 and the second light transmission window 1072 or clean either one of them (the other is cleaned by another cleaning member).

In the present exemplary embodiment, the rotation shaft 108*b* of the cleaning member 108 is configured to rotate around the second rotation axis RA2 in one direction, but the rotation shaft 108*b* is not limited to this configuration. The rotation shaft 108*b* can be configured to make the sheet 108*a* reciprocate within a predetermined range.

In the present exemplary embodiment, the sheet 108*a* of the cleaning member 108 includes the recessed portion 1083*a*. However, in a case of providing the optical sensor 200, the light transmission portion 107, and the cleaning member 108 at positions distant from the upstream screw 105, the sheet 108*a* does not need to include the recessed portion 1083*a*.

In the present exemplary embodiment, the light reception element 202 is provided at a position facing the light emission element 201. However, the light reception element 202 is not limited to this configuration. Using a reflector or a light guide makes it possible to receive light from the light emission element 201 even if the light reception element 202 is arranged at a position not facing the light emission element 201.

Figure 7:
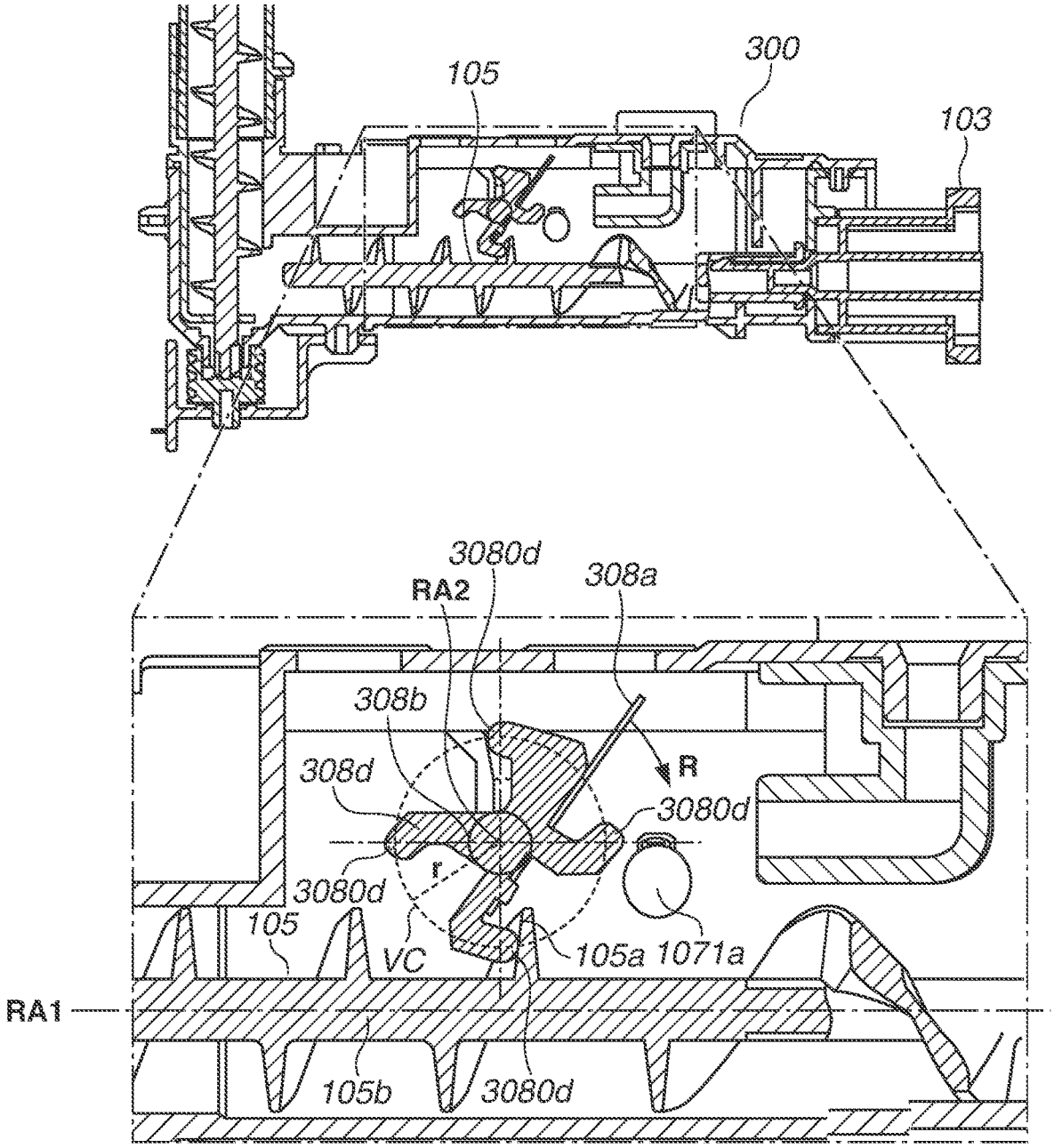
FIG. 7 is a cross-sectional view of an upstream conveyance portion according to a second exemplary embodiment.
Figure 8A:
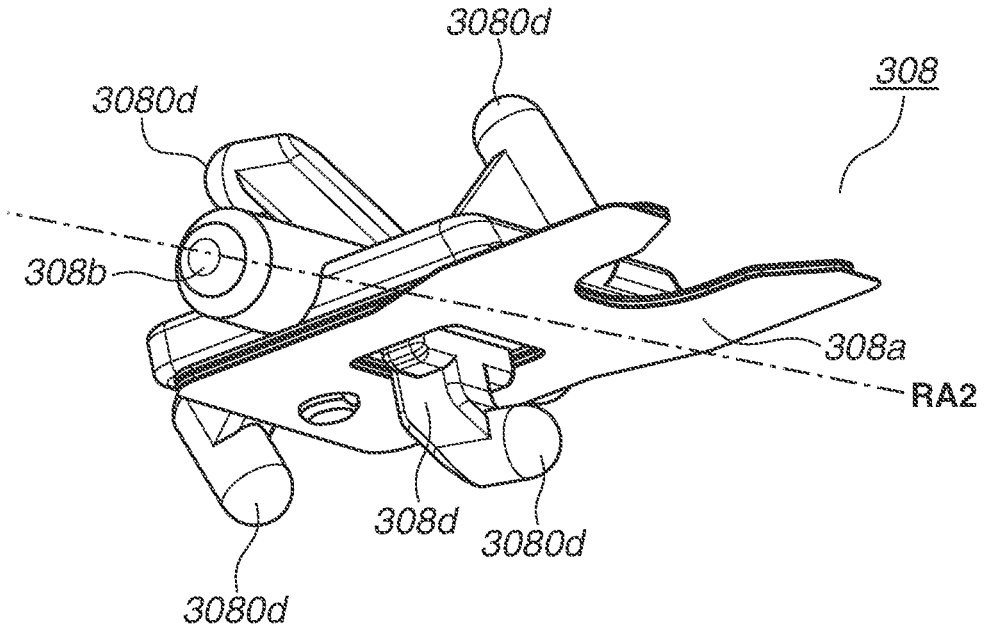
FIGS. 8A and 8B are perspective views of a cleaning member according to the second exemplary embodiment.
Figure 8B:
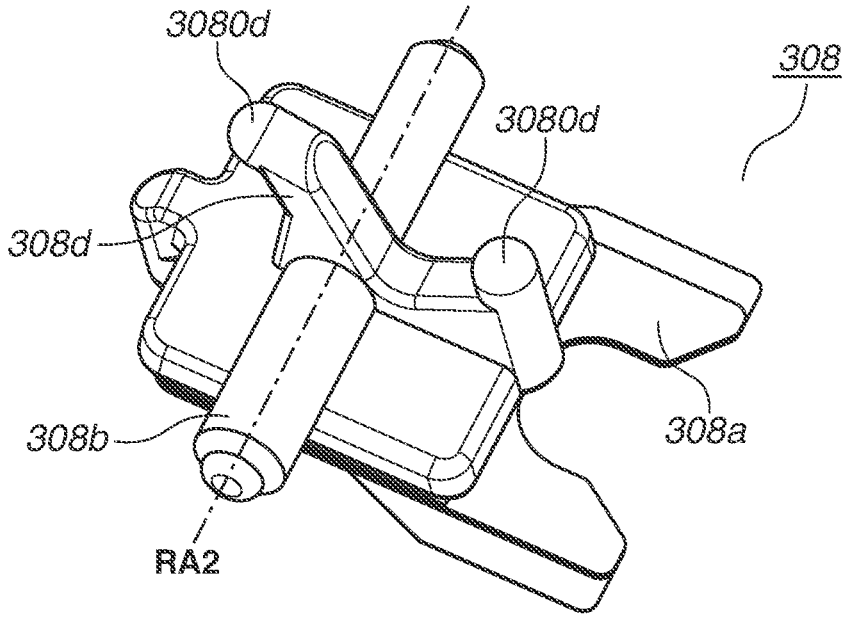

A second exemplary embodiment according to the present disclosure will be described with reference to FIGS. 7 to 9. The top view of an upstream conveyance portion 300 in the present exemplary embodiment is the same as the upstream conveyance portion 100 illustrated in FIG. 4A. FIG. 7 is a cross-sectional view of the upstream conveyance portion 300 taken along A-A of FIG. 4A. FIG. 8A is a perspective view of a cleaning member 308. FIG. 8B is a perspective view of the cleaning member 308 seen from a direction different from that in FIG. 8A.

The second exemplary embodiment is different from the first exemplary embodiment in that the cleaning member 308 rotates by a drive force from the upstream screw 105. In the other respects, the second exemplary embodiment is the same as the first exemplary embodiment and thus description thereof will be omitted.

As illustrated in FIG. 7, the cleaning member 308 is arranged in the first frame body 104. The cleaning member 308 includes a rotation shaft 308*b* (a second shaft portion) that rotates around the second rotation axis RA2 and a sheet 308*a* that rotates together with the rotation shaft 308*b*. The rotation shaft 308*b* is provided with a plurality of arm portions 308*d* (drive force reception portions) that abuts the blade portion 105*a* of the upstream screw 105 to receive a drive force. The arrangement of the second rotation axis RA2 of the rotation shaft 308*b*, and an arrangement and a shape of the sheet 308*a* are the same as those of the sheet 108*a* in the first exemplary embodiment and thus description thereof will be omitted.

<Drive Force Reception Portions>

As illustrated in FIG. 7, the plurality of arm portions 308*d* extends from the rotation shaft 308*b* in a direction away from the second rotation axis RA2 on a cross section vertical to the second rotation axis RA2. A leading end portion 3080*d* at a leading end of each arm portion 308*d* is a portion that abuts the blade portion 105*a* of the upstream screw 105 and is formed in a spherical shape as illustrated in FIGS. 8A and 8B. The centers of the plurality of leading end portions 3080*d*, each of which is in the spherical shape, are spaced every 90 degrees on a virtual circle VC with a radius r centered on the second rotation axis RA2.

FIGS. 9A to 9D are diagrams illustrating a state of the cleaning member 308 driven by the upstream screw 105 in a time-series manner.

Along with the rotation of the blade portion 105*a* of the upstream screw 105, the leading end portions 3080*d* of the arm portions 308*d* of the cleaning member 308 are pressed by the blade portion 105*a* so that the cleaning member 308 (the rotation shaft 308*b*) is rotated in a rotation direction R. While the rotation shaft 105*b* of the upstream screw 105 turns 360 degrees (one rotation) as illustrated in FIGS. 9A to 9D, the leading end portion 3080*d* of one arm portion 308*d* among the plurality of arm portions 308*d* is pressed by the blade portion 105*a* so that the cleaning member 308 turns 90 degrees. After that, while the rotation shaft 105*b* of the upstream screw 105 further turns 360 degrees, the leading end portion 3080*d* of another arm portion 308*d* among the plurality of arm portions 308*d* is pressed by the blade portion 105*a* so that the cleaning member 308 further turns 90 degrees. Repeating this cycle causes the upstream screw 105 to make four rotations so that the cleaning member 308 follows the upstream screw 105 to make one rotation. As above, the number of rotations of the cleaning member 308 per unit time is smaller than the number of rotations of the upstream screw 105 per unit time.

Figure 9A:
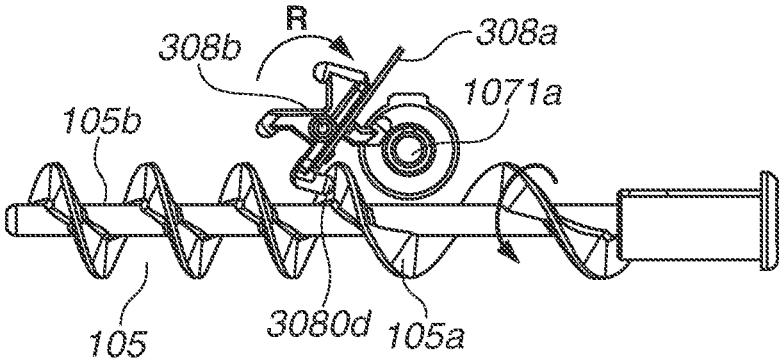
FIGS. 9A, 9B, 9C, and 9D are diagrams illustrating rotation of the cleaning member along with rotation of an upstream screw in chronological order according to the second exemplary embodiment.
Figure 9B:
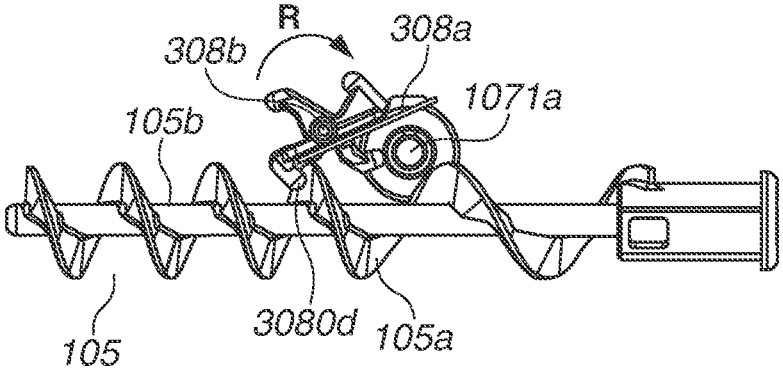
Figure 9C:
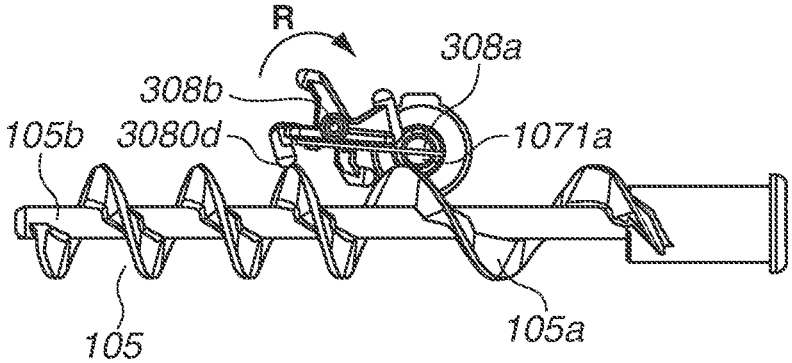
Figure 9D:
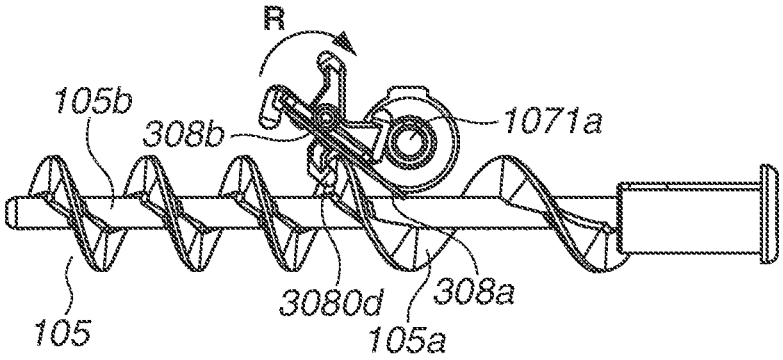

It can be seen that the sheet 308*a* rubs on the first detection surface 1071*a* as illustrated in FIGS. 9B to 9D.

Adopting the configuration of the present exemplary embodiment allows the sheet 308*a* to be rotated without interference with the blade portion 105*a* of the upstream screw 105 while the cleaning member 308 rotates as illustrated in FIGS. 9A to 9D. This can be realized by configuring the cleaning member 308 to rotate in conjunction with the movement of the blade portion 105*a* to keep the relative positions of the sheet 308*a* and the blade portion 105*a* constant at any time. Further, the configuration of the present exemplary embodiment eliminates the need to provide a drive source (motor) or a drive transfer member (gear) for rotational driving of the cleaning member 308, thereby achieving space-saving of the toner conveying apparatus 14.

In the present exemplary embodiment, the cleaning member 308 is provided with four arm portions 308*d*. However, the cleaning member 308 is not limited to this configuration. The number of the arm portions can be changed as appropriate in accordance with the pitch of the blade portion 105*a* of the upstream screw 105 or the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-213834, filed Dec. 23, 2020, which is hereby incorporated by reference herein in its entirety.

What is claimed is:

1. A toner conveying apparatus used in an image forming apparatus including a light emission portion and a light reception portion, the toner conveying apparatus comprising:

a frame body configured to form a conveyance passage surrounded by a wall portion;

a conveyance member that is provided in the conveyance passage and that is configured to rotate around a first rotation axis to convey toner;

a light transmission portion (i) which is provided in the wall portion, (ii) which has translucency, (iii) through which the light emission portion is configured to emit light toward an inside of the conveyance passage, and (iv) through which the light reception portion is configured to receive the light emitted from the light emission portion and passing through the inside of the conveyance passage; and a rubbing member configured to rub on a light passing surface of the light transmission portion by being rotated around a second rotation axis extending in a direction crossing the first rotation axis, the light passing surface facing in a direction of the second rotation axis, the rubbing member being configured to be rotated by a rotation of the conveyance member.

2. The toner conveying apparatus according to claim 1, wherein the conveyance member includes a first shaft portion configured to rotate around the first rotation axis and a blade portion that is provided outside the first shaft portion and that is configured to rotate together with the first shaft portion, and wherein the rubbing member includes a second shaft portion configured to rotate around the second rotation axis and a sheet configured to rotate together with the second shaft portion to rub on the light passing surface of the light transmission portion.

3. The toner conveying apparatus according to claim 2, wherein the second shaft portion of the rubbing member overlaps the first shaft portion when viewed in a first direction crossing both the first rotation axis and the second rotation axis, wherein the light transmission portion includes a first light transmission window and a second light transmission window (i) that are aligned in a direction along the second rotation axis and (ii) that have a light entrance surface and a light exit surface, respectively, which face in a direction of the second rotation axis, the light passing surface including the light entrance surface and the light exit surface, wherein the first light transmission window is opposite to the second light transmission window with respect to the first rotation axis in the direction along the second rotation axis, wherein the light emission portion is configured to emit light toward the inside of the conveyance passage through the light entrance surface of the first light transmission window, and the light reception portion is configured to receive the light emitted from the light emission portion through the light exit surface of the second light transmission window, and wherein a first end portion of the sheet in the direction of the second rotation axis and a second end portion of the sheet opposite to the first end portion in the direction of the second rotation axis are configured to, while the rubbing member is being rotated, rub on the light entrance surface of the first light transmission window and the light exit surface of the second light transmission window, respectively.

4. The toner conveying apparatus according to claim 3, wherein the rubbing member includes a drive force reception portion configured to receive a driving force for rotating the rubbing member by engaging with the blade portion of the conveyance member while the conveyance member is being rotated.

5. The toner conveying apparatus according to claim 4, wherein the drive force reception portion includes a plurality of arm portions extending from the second shaft portion in a direction away from the second rotation axis on a cross section vertical to the second rotation axis and being spaced in a rotation direction of the rubbing member.

6. The toner conveying apparatus according to claim 4, wherein the blade portion of the conveyance member is a spiral portion of which a spiral axis is the first rotation axis.

7. The toner conveying apparatus according to claim 3, wherein the sheet includes a recessed portion that is recessed in a direction approaching the second rotation axis at an end portion of the sheet in a direction orthogonal to the second rotation axis, where the recessed portion of the sheet is provided between the first end portion and the second end portion of the sheet in the direction of the second rotation axis, and wherein at least a portion of the first shaft portion is configured to enter the recessed portion of the sheet while the rubbing member is being rotated.

8. The toner conveying apparatus according to claim 3, wherein the frame body is provided with a reception inlet for receiving toner from outside of the toner conveying apparatus, and wherein an area between the first light transmission window and the second light transmission window in the conveyance passage is an area through which the toner discharged from the reception inlet passes.

9. The toner conveying apparatus according to claim 3, wherein the first end portion and the second end portion of the sheet are configured to, while the rubbing member is being rotated, rub on the first light transmission window and the second light transmission window, respectively, at the same time.

10. The toner conveying apparatus according to claim 2, wherein the rubbing member includes a drive force reception portion configured to receive the driving force by engaging with the blade portion of the conveyance member while the conveyance member is being rotated.

11. The toner conveying apparatus according to claim 10, wherein the blade portion of the conveyance member is a spiral portion of which a spiral axis is the first rotation axis.

12. The toner conveying apparatus according to claim 10, wherein the drive force reception portion includes a plurality of arm portions extending from the second shaft portion in a direction away from the second rotation axis on a cross section vertical to the second rotation axis and being spaced in a rotation direction of the rubbing member.

13. The toner conveying apparatus according to claim 12, wherein the blade portion of the conveyance member is a spiral portion of which a spiral axis is the first rotation axis.

14. The toner conveying apparatus according to claim 1, wherein the rubbing member includes a plurality of arm portions extending from the second shaft portion in a direction away from the second rotation axis on a cross section vertical to the second rotation axis and being spaced in a rotation direction of the rubbing member, and wherein the conveyance member is configured to engage with the plurality of arm portions to rotate the rubbing member.

15. The toner conveying apparatus according to claim 1, wherein the number of rotations of the rubbing member per unit time is smaller than the number of rotations of the conveyance member per unit time.

16. The toner conveying apparatus according to claim 1, wherein the frame body forms a second conveyance passage elongated in a direction of the first rotation axis.

17. The toner conveying apparatus according to claim 1, wherein the frame body is provided with a reception inlet for receiving toner from outside of the toner conveying apparatus, and wherein a tube extending in a direction of the first rotation axis is provided so that the toner received from the reception inlet is discharged in the inside of the conveyance passage in the direction of the first rotation axis.

18. The toner conveying apparatus according to claim 1, wherein the frame body is provided with a reception inlet for receiving toner from outside of the toner conveying apparatus, and wherein the reception inlet, the light transmission portion, and the second rotation axis of the rubbing member are provided in this order in a direction in which the conveyance member conveys the toner.

19. A toner conveying apparatus comprising:

a frame body configured to form a conveyance passage surrounded by a wall portion;

a conveyance member that is provided in the conveyance passage and that is configured to rotate around a first rotation axis to convey the toner;

a light transmission portion which is provided in the wall portion and has translucency, the light transmission portion including a first light transmission window and a second light transmission window having a light entrance surface and a light exit surface, respectively; and a rubbing member configured to rub on the light entrance surface of the first light transmission window and the light exit surface of the second light transmission window by being rotated around a second rotation axis extending in a direction crossing the first rotation axis, wherein the light entrance surface of the first light transmission window and the light exit surface of the second light transmission window face in a direction of the second rotation axis, wherein the first light transmission window and the second light transmission window are aligned in a direction along the second rotation axis, and wherein the first light transmission window is opposite to the second light transmission window with respect to the first rotation axis in the direction along the second rotation axis.

20. The toner conveying apparatus according to claim 19, wherein the rubbing member is configured to, while the rubbing member is being rotated, rub on the light entrance surface of the first light transmission window and the light exit surface of the second light transmission window at the same time.

21. The toner conveying apparatus according to claim 19, wherein the rubbing member is configured to be rotated by a rotation of the conveyance member.

22. The toner conveying apparatus according to claim 21, wherein the conveyance member includes a first shaft portion configured to rotate around the first rotation axis and a blade portion that is provided outside the first shaft portion and configured to rotate together with the first shaft portion, wherein the rubbing member includes a second shaft portion configured to rotate around the second rotation axis and a sheet configured to rotate together with the second shaft portion to rub on the light transmission portion, and wherein the rubbing member includes a drive force reception portion configured to receive the driving force for rotating the rubbing member by engaging with the blade portion of the conveyance member while the conveyance member is being rotated.

23. The toner conveying apparatus according to claim 22, wherein the blade portion of the conveyance member is a spiral portion of which a spiral axis is the first rotation axis, and wherein the drive force reception portion is a plurality of arm portions extending from the second shaft portion in a direction away from the second rotation axis on a cross section vertical to the second rotation axis and being spaced in a rotation direction of the rubbing member.

* * * * *